United States Patent [19]

Weiler et al.

[11] Patent Number: 4,883,091

[45] Date of Patent: Nov. 28, 1989

[54] MULTI-PORT SELF-REGULATING PROPORTIONAL PRESSURE CONTROL VALVE

[75] Inventors: Charles A. Weiler, Holly, Mich.; Logan H. Mathis, Lavonia, Ga.

[73] Assignee: Ross Operating Valve Company, Troy, Mich.

[21] Appl. No.: 290,745

[22] Filed: Dec. 27, 1988

[51] Int. Cl.[4] ..... F15B 13/043

[52] U.S. Cl. ..... 137/625.64; 91/48; 91/433; 137/625.62

[58] Field of Search ..... 91/48, 433; 137/625.62, 137/625.64

[56] References Cited

U.S. PATENT DOCUMENTS

| | | | |
|---|---|---|---|
| 2,931,389 | 4/1960 | Moog et al. | 137/625.62 |
| 2,964,059 | 12/1960 | Geyer | 137/625.62 |
| 3,015,317 | 1/1962 | Buchanan et al. | 137/625.62 |
| 3,434,390 | 3/1969 | Weiss | 137/625.61 X |
| 3,804,120 | 4/1974 | Garnett | 137/625.64 |
| 3,964,518 | 6/1976 | Hesse et al. | 137/625.64 |
| 4,023,593 | 5/1977 | Piccardo | 137/625.64 |
| 4,041,983 | 8/1977 | Bianchetta | 137/625.66 X |
| 4,066,102 | 1/1978 | Tandrup | 137/625.64 |
| 4,126,293 | 11/1978 | Zeuner et al. | 137/625.64 X |
| 4,211,256 | 7/1980 | Sturtz | 137/625.64 |

FOREIGN PATENT DOCUMENTS

| | | | |
|---|---|---|---|
| 276056 | 7/1988 | European Pat. Off. | 137/625.64 |
| 2460993 | 7/1975 | Fed. Rep. of Germany | 91/433 |

*Primary Examiner*—Gerald A. Michalsky

*Attorney, Agent, or Firm*—Harness, Dickey & Pierce

[57] ABSTRACT

A multi-port, self-regulating, proportional control valve preferably uses a load output feedback system to produce working fluid load output pressures that are proportional to pilot control fluid pressures. In some embodiments, the control valve is programmable and capable of different load output pressures selected either prior to, or during, operation. The control valve apparatus according to the present invention is capable of a center-off or neutral condition that requires substantially no pilot control flow when there in no control valve output flow.

20 Claims, 4 Drawing Sheets

MULTI-PORT SELF-REGULATING PROPORTIONAL PRESSURE CONTROL VALVE

BACKGROUND AND SUMMARY OF THE INVENTION

The present invention relates generally to proportional fluid control valves, and most advantageously to four-way, proportional pressure control valves having self-regulating capabilities.

Various fluid control valves have been frequently provided in the prior art for controlling the operation of a fluid system, such as a fluid-powered cylinder or other fluid-powered device, in which a control fluid pilot operator system is used to effect operation of the control valve. Many of such fluid control valves have been proportionally controllable, but such control valves have not typically provided for accurate, self-regulating, proportional control such as that necessary for use in devices such as industrial robots, or other such devices, where close control and regulation is desired or necessary. Although proportionality is frequently achieved through the use of variable regulators, or the like, such devices are relatively expensive and thus limit the application of such valves, especially in pneumatic pilot operator systems where proportional control is desired or required. Furthermore, even where such proportionality has been achieved in less expensive ways, such valves or systems have typically not been self-regulating, at least without resort to expensive, complicated, or relatively imprecise associated systems or apparatuses.

Therefore, one of the principal objects of the present invention is to provide an improved, four-way, self-regulating control valve that is relatively simple and inexpensive, and that provides for more closely regulated proportional pressure control wherein relatively small spool or valve member movements result in relative pressure differences, thus providing for corrective spool or valve member movement to maintain desired output pressures. It should be noted that the principles of the invention are also applicable to other types of control valves, including but not limited to two-way and three-way valves. Another object of the present invention is to provide such a self-regulating control valve that is programmable and capable of variable load pressures, either prior to operation or during operation, and that requires substantially no pilot control flow or other signal input at its center-off, or neutral, condition.

It is also an object of at least some versions of the present invention to provide for infinite load pressure selectablility, or in other versions of the present invention, to provide for a pulse-width modulated input signal in order to cause pilot control pressures to vary differentially, with control flow outlet being proportional to the differential pilot signals.

Additional objectives, advantages, and features of the present invention will become apparent from the following description and the appended claims, taken in conjunction with the accompanying drawings.

BRIEF DESCRIPTION OF THE DRAWINGS

FIG. 4 is a schematic representation, illustrating still another embodiment similar to that of FIG. 3, but incorporating a feature wherein load output modulation can be accomplished by way of input signal pulse width modulation.

DETAILED DESCRIPTION OF THE PREFERRED EMBODIMENTS

FIGS. 1 through 4 illustrate various preferred embodiments of self-regulating, proportional pressure control valves according to the present invention. Although the present invention is particularly adaptable and advantageous in pneumatic control valves, and is shown for purposes of illustration in a spool-type pneumatic control valve, one skilled in the art will readily recognize that the principles of the present invention are equally applicable to poppet valves, other known types of pneumatic valves, and even to various types of hydraulic control valves.

Figure 1:
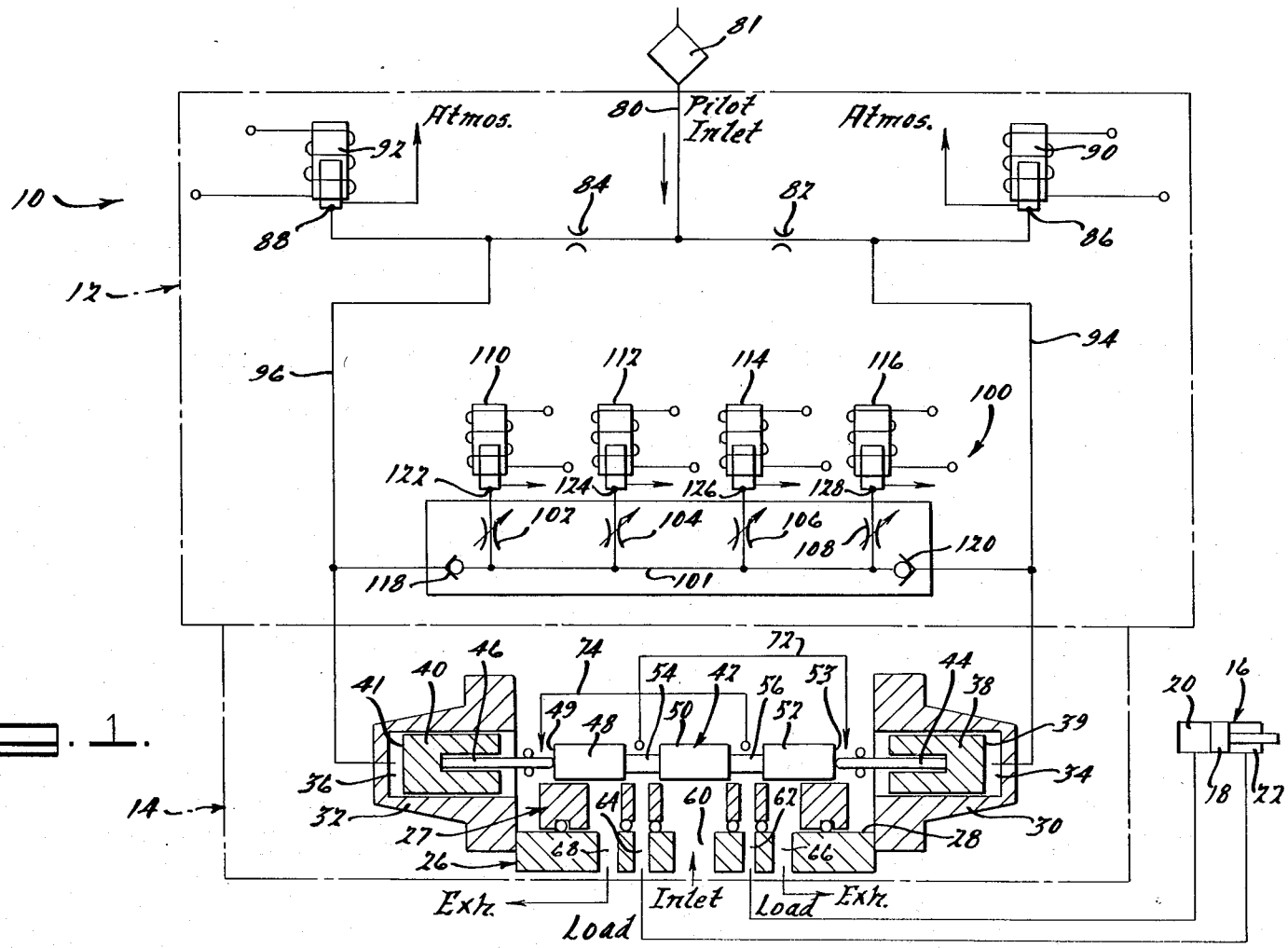
FIG. 1 is a schematic representation of a four-way, self-regulating, proportional pressure control valve and pilot operator system in accordance with the present invention.

In FIG. 1, an exemplary self-regulating, four-way proportional pressure control valve assembly 10 generally includes a pilot operator portion 12 and a working fluid outlet portion 14. In the illustrative example shown schematically in FIG. 1, the control valve assembly 10 is adapted for controlling the operation of a working fluid-powered device, such as the cylinder 16, including a reciprocable piston 18 that divides the cylinder 16 into two working fluid chambers 20 and 22. By alternately pressurizing and exhausting the fluid chambers 20 and 22, reciprocable motion of the piston 18 is effected to drive an associated system or device, and by controlling the pressure levels in the fluid chambers 20 and 22, it is possible to control the output force levels of the cylinder, regardless of piston velocity. One skilled in the art will readily recognize that other types of fluid-operated systems or devices, such as rotary motors, turbines, etc., can be controlled by the proportional pressure control valve assembly 10.

The output portion 14 of the control valve assembly 10 generally includes a control valve body, schematically illustrated and indicated by reference numeral 26, with a bore 28 extending through the body 26, which is closed off at opposite ends by end closures or caps 30 and 32. The end caps 30 and 32 have respective bores 34 and 36 extending longitudinally through a portion thereof, for slidably receiving respective control pistons 38 and 40.

A spool 42 is slidably housed within a sleeve 27 in the bore 28 of the body 26, and is interconnected with control pistons 38 and 40 by way of respective push rods or pins 44 and 46. The spool 42 includes a number of lands 48, 50, and 52, which are spaced apart to form recesses 54 and 56 therebetween on the spool 42. In the schematically illustrated embodiment of the control valve assembly 10 shown in FIG. 1, the ends 39 and 41 of the control pistons 38 and 40, respectively, are larger than the ends 49 and 53 of the lands 48 and 52, respectively, on the spool 42. A typical ratio of the area of the end 41 of the control piston 40 to the end 49 of the land 48, and similarly the area ratio of the end 39 of the control piston 38 to the end 53 of the land 52, is approximately two-to-one, although other area ratios can alternatively be employed, depending upon the proportional pressure control level desired in a given application. The purpose of such end area relationship is discussed in more detail below.

The output portion 14 of the control valve assembly 10 also includes an inlet port 60, which provides fluid communication from a pressurized working fluid source (not shown) and the interior midpoint of the sleeve bore 28 extending through the control valve body 26. Similarly, a pair of load ports 62 and 64, which are in fluid communication with the fluid chambers 20 and 22, respectively, of the cylinder 16, also provide fluid communication with the interior of the bore 28. Finally, a pair of exhaust ports 66 and 68 are provided in the body 26 in order to provide fluid communication between the interior of the bore 28 and the atmosphere or other exhaust region, as is well-known to those skilled in the art.

The pilot operator portion 12 of the control valve assembly 10 includes a pilot control fluid inlet 80, which is in fluid communication, preferably by way of a filter 81, with a source of pressurized pilot control fluid (not shown). The pilot inlet port 80 splits into two opposed pilot circuits, which include fixed pilot orifices 82 and 84, respectively. The control fluid flows through the respective fixed pilot orifices 82 and 84 and is in communication with a pair of exhaust or vent orifices 86 and 88, respectively, which can be alternately closed or opened by operation of solenoid operators 90 and 92, respectively. It should be noted, as will become readily apparent from the discussion below, that the solenoid operators 90 and 92 can optionally be replaced by other known types of on/off operators, or even by signal modulating operators, or by other variable operators, as will be explained in more detail below. The pilot fluid circuits or internal ports or passageways 94 and 96 are connected in fluid communication with the respective bores 34 and 36, in the end caps 30 and 32, respectively, and with the pilot control pressure levels downstream of the respective fixed pilot orifices 82 and 84.

A load level control apparatus 100 is in fluid communication with both of the pilot ports 94 and 96, which are isolated from one another by a pair of check valves 118 and 120 in a load level control port 101. A number of adjustable pilot control orifices 102, 104, 106, and 108, are connected in parallel with the load level control port 101, between the check valves 118 and 120. These adjustable orifices are in series fluid communication with respective normally closed exhaust orifices 122, 124, 126, and 128, which in turn can be alternatively opened or closed by respective solenoid operators 110, 112, 114, and 116. Such solenoid operators 110 through 116, which can also be optionally replaced by other known types of operators, serve to block control fluid flow through the corresponding variable pilot control orifices 102 through 108, respectively, when the respective orifices 122 through 128 are closed to exhaust.

The illustrative and exemplary pressure control valve assembly 10, according to the present invention, is capable of several operating modes or conditions, all of which are described below. In the center-off or neutral mode, filtered control air enters the pilot portion 12 through the pilot inlet 80, after which its flow divides and is communicated through the small, fixed pilot orifices 82 and 84. When the solenoid operators 90 and 92, along with their respective orifices 86 and 88, are in their de-energized and closed conditions, pilot fluid flow is blocked, and the pilot control fluid pressures in the pilot ports 94 and 96 both stabilize generally at pilot inlet fluid pressure level. This condition assumes, of course, that the solenoids 110 through 116 in the load level control apparatus are also de-energized so as to hold the respective orifices 122 through 128 in their closed conditions.

Such stabilized pilot inlet pressures in the pilot ports 94 and 96 are in communication with the respective bores 34 and 36, with their respective control pistons 38 and 40. Since these control pressures are equal, but act in opposite directions on the respective control pistons 38 and 40, the spool 42 in the output portion 14 remains at its center-off position, with the working fluid flow from the inlet port 60 being prevented from passing to other portions of the bore 28 in the body 26, such as the load ports 62 and 64. Thus, the control valve assembly 10 of the present invention maintains the center-off position of the spool 42 with zero load port pressures, and accomplishes this condition with substantially no pilot fluid flow or electrical input, with the possible exception of a very small, negligible system leakage or loss.

The control valve assembly 10 in FIG. 1 is also capable, however, of an "unregulated" mode of operation in the sense that the pressure at the load outlet ports is not controlled. In this mode, the spool 42 is operated either at its extreme right or left travel positions, or at its zero output center position. When the spool 42 is at one of its maximum travel positions, the load output is essentially the same as the supply pressure, and is thus unregulated.

In this mode of operation, the solenoid operators 110 through 116 are de-energized, thus maintaining the exhaust orifices 122 through 128, respectively, in their closed condition. When movement of the piston 18 to the left, as shown in FIG. 1, is desired, the solenoid 90 in the pilot operator portion 12 is energized in order to open the orifice 86 to atmosphere, thus allowing control fluid flow through the fixed pilot orifice 82 to exhaust to atmosphere. The size of the open orifice 86 is several times larger than the size of the opening through the fixed orifice 82, thus causing the pressure in the pilot port 94 to drop to atmospheric, or near atmospheric, level.

Because the control fluid pressure in the pilot port 96 is at or near inlet control fluid pressure, and the pressure in the pilot port 94 is substantially equal to atmospheric pressure, a large force unbalance is created on the control pistons 38 and 40. This results in a substantially full movement of the spool 42 to the right, as viewed in FIG. 1, until such movement is stopped by contact between the end 39 of the control piston 38 and the end wall of the bore 34 in the end cap 30, or due to engagement of the spool 42 with a spool stop (not shown). In this spool position, the inlet port 60 is in fluid communication, by way of the recess 54 with the load port 64, thus pressurizing the right-hand fluid chamber 22 of the cylinder 16. Simultaneously, because of the movement of the spool 42 to the right, the load port 62 is in fluid communication, by way of the recess 56, with the exhaust port 66, thus exhausting the left-hand fluid chamber 20 of the cylinder 16. As is well-known to those skilled in the art, such a pressure imbalance between the fluid chambers 22 and 20 causes the piston 18 to move leftward within the cylinder 16, and a mechanical connection between the piston 18 causes operation of an associated device or system.

If the operation of the control valve assembly 10 described above is reversed, namely if the solenoid 90 is de-energized, and the solenoid 92 is energized, the respective orifices 86 and 88 reverse their positions, with the orifice 86 being closed and the orifice 88 being opened. In a manner similar, but opposite, to that described above, this operation will result in opposite movement of the spool 42 all the way to the left in the output portion 14, thus pressurizing the fluid chamber 20 and depressurizing the fluid chamber 22 in the cylinder 16 and causing rightward movement of the piston 18.

The output portion 14 of the control valve assembly 10 also preferably includes a pair of internal feedback ports or passageways 72 and 74, which provide for a "self-regulated" mode of operation. This self-regulated mode of operation comes into play only with lower load pressures, resulting from lower pilot pressures such that the spool 42 is operated at positions between the extreme travel ends.

The feedback passageways 72 and 74 provide fluid communication between the recess 54 and the end 53 of the spool 42, and between the recess 56 and the end 49 of the spool 42, respectively. When control or pilot pressure is exerted on the piston 38, the spool 42 is moved to the left, as viewed in FIG. 1, and the internal feedback passageway 74 provides fluid communication from the load port 62, by way of the recess 56, to the spool end 49 in order to provide a rightwardly-directed load pressure feedback to the end spool 49. This opposes the leftward movement of the spool 42. Because the area of the end 39 of the piston 38 differs from the area of the end 49, the spool tends to stabilize at a force-balanced leftward position such that the load pressure at load port 62 is proportional to the pilot pressure and is in the same ratio to the pilot pressure at the piston end 39 as the ratio of the area of the piston end 39 to the area of the spool end 49 (two-to-one, for example). Simultaneously, the feedback passageway 72 is vented to atmosphere because such leftward movement of the spool 42 causes communication between the feedback passageway 72 and the recess 54 with the exhaust port 68, as well as causing communication of the load port 64 with the exhaust port 68.

Conversely, when control or pilot pressure is exerted on the end 41 of the piston 40, the spool 42 is moved to the right, as viewed in FIG. 1. The internal feedback passageway 72 then provides fluid communication from the load port 64, by way of the recess 54, to the spool end 53 in order to provide a leftwardly-directed load pressure feedback to the spool end 53. This opposes the rightward movement of the spool 42, causing the spool 42 to stabilize at a force-balanced rightward position such that the load pressure at load port 64 is proportional to the pilot pressure and is in the same ratio as the ratio of the area of the piston end 41 to the area of the spool end 53 (two-to-one, for example). Simultaneously, the feedback passageway 74 is vented to atmosphere because the rightward movement of the spool 42 causes communication between the feedback passageway 74 and the recess 56 with the exhaust port 66, as well as causing communication of the load port 62 with the exhaust port 66.

As a result of the feedback feature discussed above, an increase or decrease in the load pressure at either of the load ports due to changes in system loading will cause the spool to shift either leftward or rightward in order to cause a pressure correction and maintain the above-mentioned spool force balance, thus maintaining the load output pressure substantially constant regardless of the load output flow level, all of course within the limits of the control valve capacity.

In still another mode of operation, described below, the control valve assembly 10 is remotely operable and programmable, either in a pre-adjustable manner as in the following description, or in a continuously variable manner, which will be described and explained still later in this detailed description.

In the "regulated" mode, the control valve assembly 10 is provided with a pressure selectivity in which two or more pressure levels can be preset. In this operating mode, the variable load control orifices 102, 104, 106, and 108, which are ported to their respective normally-closed, solenoid-operated exhaust orifices 122, 124, 126, and 128, are each independently adjustable. It should be noted that although four adjustable pilot control orifices 102 through 108 are shown for purposes of illustration in FIG. 1, the system can alternately have any number of such adjustable pilot control orifices. In addition, one or more of these preset adjustable pilot control orifices 102 through 108 can be remotely called into play by operation of the corresponding associated solenoid-operated exhaust orifices 122 through 128 to cause any of a number of preset load pressure levels to be available at either the load port 62 or the load port 64.

The operation of this pressure selectivity feature, and other aspects of the invention, can perhaps best be described by way of the following example. Assume that leftward movement of the piston 18 in the cylinder 16 is desired, that the pressure in the chamber 22 of the cylinder 18 is desired to be limited to a maximum of 20 p.s.i.g., and that the valve inlet pressure at the inlet port 60 is 100 p.s.i.g. Initially the spool 42 is in its center-off or neutral position so long as all the solenoids are not energized, thus resulting in no load output at load ports 64 and 66.

When the solenoid 90 is energized, the orifice 86 is opened, and the pilot pressure at the pilot port 94 and the pressure at the piston end 39 of the piston 38 both drop to atmospheric level. Because the piston end 41 of the piston 40 is still subjected to pilot pressure, the large differential force on the pistons 38 and 40 causes the spool 42 to move to the right, as viewed in FIG. 1. If the adjustable orifice 102 has been preset to a 10 p.s.i.g. pressure drop, energizing the solenoid 110 will open the orifice 122 and cause the pilot pressure in the pilot port 96 to drop to 10 p.s.i.g. due to pilot air being exposed to atmosphere by way of the adjustable orifice 102 and the open orifice 122. As inlet air from the valve inlet 60 flows past the open land 50, and through the recess 54, the pressure at the load port 64 is maintained essentially at 20 p.s.i.g. This is due to the above-described internal feedback from the recess 54, through the feedback passageway 72, to the spool end 53. This feedback maintains a force balance on the spool 42, due to the preferred two-to-one area ratio of the piston end 41 to the spool end 53, thus causing the spool position to self-regulate, or self-correct, to thereby maintain the load output pressure at the desired 20 p.s.i.g., which is required to balance the preset 10 p.s.i.g. pilot pressure in the pilot port 96. Thus the pressure in the cylinder chamber 22 is maintained essentially at 20 p.s.i.g., its desired maximum level, regardless of the output velocity at the cylinder 18.

It should be noted that in the above example, pilot air in the pilot port 96 passes through the check valve 118, but is prevented from entering the pilot port 94 by the check valve 120. It should also be noted that if the 20 p.s.i.g. load output is desired to be transferred to the opposite cylinder chamber 20 in order to move the piston 18 rightwardly, all that needs to be done is to energize the solenoid 92 as the solenoid 90 is de-energized, thus reversing the movement of the spool 42, while leaving the solenoid 110 in its energized state.

Because of the feedback provision discussed above in connection with the feedback passageways or internal ports 72 and 74, however, coupled with the preselected ratio of the spool end area to the control piston end area, the spool will always stabilize at a force-balanced position that provides the same ratio of load pressure to the pilot pressure as is the ratio of the control piston end area to the spool end area. Therefore, if this end area ratio is two-to-one, as in the example given above, the spool will stabilize and come to rest at a position that results in a self-regulated load pressure of 20 p.s.i.g. for a preset pilot pressure of 10 p.s.i.g.

It will now become apparent to one skilled in the art that the "regulated" mode of operation discussed above provides for a number of self-regulated, selective load pressures, with the capability of at least four independently adjustable preset pilot pressures being shown in the example illustrated in FIG. 1, each corresponding to one of the four adjustable orifices 102 through 108.

Still another selectable load pressure is the load pressure that results if all of the solenoids 110 through 116 are de-energized (and the associated respective orifices 122 through 128 are closed), and only the solenoid 90 or 92 is energized, in which case the load pressure at either the load port 64 or the load port 62, respectively, is essentially equal to the inlet pressure, and is essentially unregulated, as is discussed above.

Correspondingly, it can now be seen that any of several preselected load pressures (proportional to preselected pilot pressures) can be maintained merely by energizing one of the solenoids 110 through 116, each of which is associated with one of the preset variable pilot orifices 102 through 108, each of which in turn can be pre-adjusted to different pressure drops, thus resulting in a variety of different pilot control pressures. In addition, any two or more of the solenoids 110 through 116 can be energized simultaneously, in order to cause simultaneous flow through the respective corresponding variable pilot control orifices 102 through 108, thus providing even lower selectable pilot control pressures and resultant proportional load pressures.

Furthermore, because the solenoids 110 through 116 can be energized singly or in various combinations, it is possible to achieve a pilot control pressure (and resultant proportional load pressure) that is lower than that resulting from operation of the lowest set variable pilot control orifice 102, 104, 106, or 108. This is because operation of any one of the variable orifices in conjunction with operation of the lowest set variable orifice results in a reduction of pilot pressure upstream of each of the variable orifices to which flow is being allowed.

For example, if the variable pilot control orifice 102 is set for a load pressure of 20 p.s.i.g. when the solenoid 110 is singly energized, and if the variable pilot control orifice 104 is set at 20 p.s.i.g. for a load pressure of 40 p.s.i.g. when the solenoid 112 is singly energized, energization of both the solenoids 110 and 112 will result in a reduction in pilot pressure, which in turn corresponds to a load pressure less than the 20 p.s.i.g. level for which variable pilot control orifice 102 is set. It should be noted that the setting of the variable pilot control orifices 102 through 108 is preferably done with each of the variable pilot control orifices singly in operation, independently of the other variable load control orifices, and such pre-adjustment or presetting is preferably done to achieve a desired load output pressure attainable when the orifice being adjusted is brought into play by energizing its associated solenoid.

Before considering other alternate embodiments of the present invention, it should be pointed out that in the various exemplary embodiments shown herein for purposes of illustration, the spool 42 and the sleeve 27, are preferably of the conventional, close-fitting, hardened and ground component configuration. O-ring type seals for outside-diameter sealing are used on the sleeve 27 to seal in the body 26. The end caps 30 and 32 each preferably house close-fitting, axially-mounted control pistons, which bear against the spool ends by way of the push rods or push pins 44 and 46, which act through low-friction seals.

In the embodiment of the present invention shown in FIG. 1, the variable pilot control orifices 102 through 108 can be arbitrarily and independently pre-adjusted and locked to produce the desired load pressure level. It should be noted, however, that such pre-adjusted pilot pressure setting can only be made and later called into operation by energizing the corresponding solenoids 110 through 116, either singly or in any of a number of combinations. Thus, the control valve assembly 10 shown for purposes of illustration in FIG. 1 is pre-programmable and remotely and selectively operable to effect any of a finite number of pre-selected pilot pressure and load pressure levels. In some systems, however, it is necessary, or at least desirable or advantageous, to provide for an infinite number of selectively variable load pressure levels. A control valve assembly 110 adapted to provide this capability is described below and schematically illustrated in FIG. 2, wherein many of the components are substantially the same as those of FIG. 1, and are thus indicated by the same reference numerals.

Figure 2:
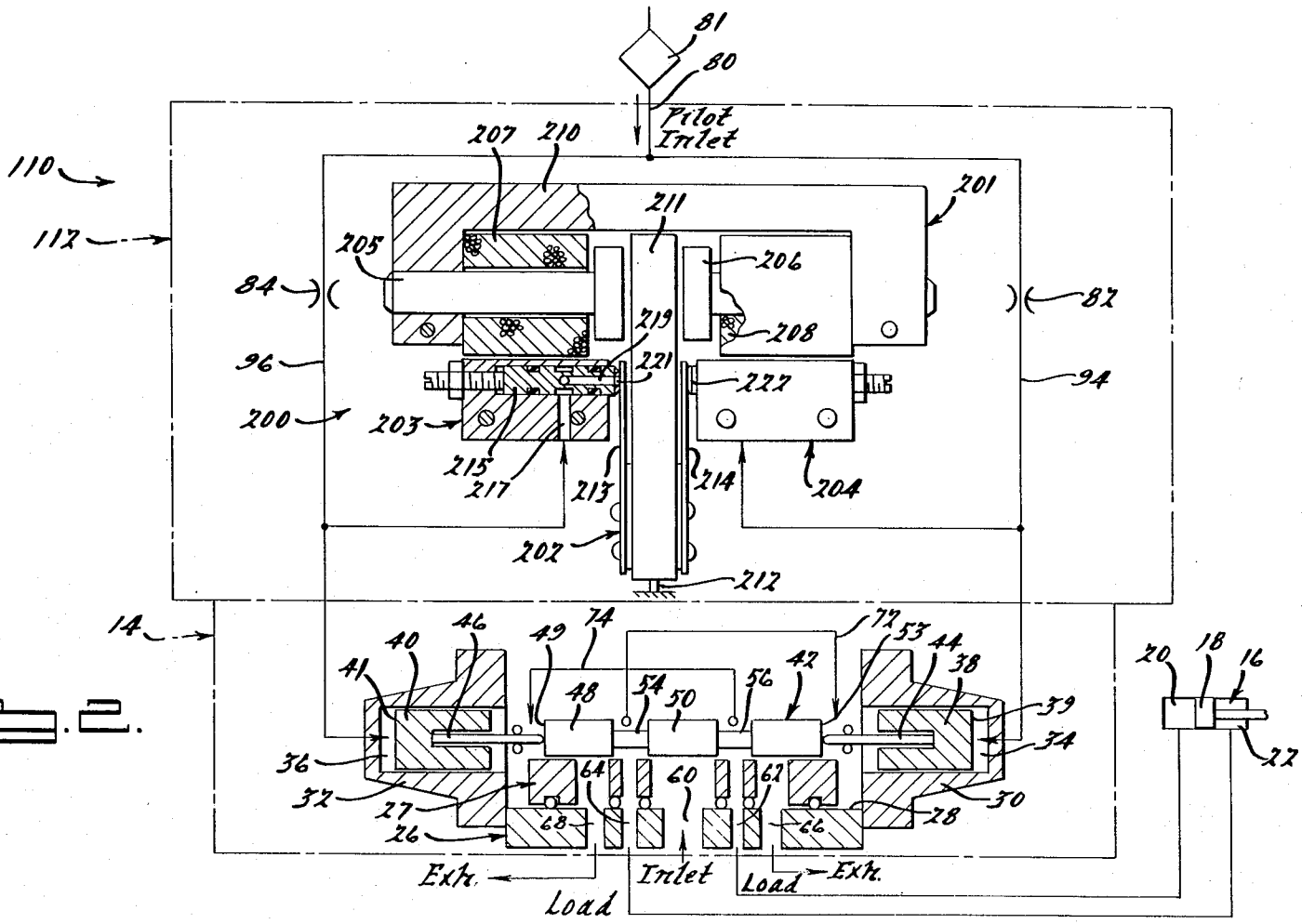
FIG. 2 is a schematic representation similar to that of FIG. 1, but illustrating an optional construction providing for an infinitely variable output load pressure level proportional to an infinitely variable pilot control pressure.

In FIG. 2, the pilot level control apparatus 100, as well as the solenoids 90 and 92 and their corresponding exhaust or vent orifices 86 and 88, are replaced by an infinitely variable pilot level control apparatus 200. The preferred pilot level control apparatus 200 includes a spring-centered, bi-directional, opposed-coil torque motor 201, which operates to move its armature assembly 202 between opposed pilot control nozzle assemblies 203 and 204.

The electro-magnetic torque motor 201 includes opposed pole pieces or cores 205 and 206, generally surrounded by respective electrical coils 207 and 208, which are independently energizable at infinitely varying input current levels, up to the capacity of the torque motor 201. A yoke 210 transcends the opposite ends of the pole pieces 205 and 206 and serves as a conduit or path for magnetic flux.

An armature member 211 is preferably resiliently supported for spring-centered pivotal movement between the pilot control nozzle assemblies 203 and 204 by a resilient spring support member 212, although other spring-centered pivotal support devices can alternately be employed so long as they allow sufficiently free pivotal movement of the armature member 211, as will be described in further detail below. Attached to opposite sides of the longitudinally-extending armature member 211 are longitudinally-extending resilient nozzle closure members 213 and 214. The closure members 213 and 214 function similar to cantilevered leaf springs with their free ends laterally spaced on opposite sides of the armature member 211, such that they are resiliently biased in opposite directions toward the respective pilot control nozzle assemblies 203 and 204. In this regard, it should be noted that other types of oppositely and resiliently biased closure devices may be used in lieu of the cantilevered leaf spring-type closure members 213 and 214, as will become apparent to those skilled in the art from the discussion below of the operation of the torque motor 201.

Preferably the pilot control nozzle assemblies 203 and 204 include respective adjustable nozzle members, only one of which (nozzle member 215 in assembly 203) is shown in FIG. 2 as a typical construction for both assemblies 203 and 204. A nozzle inlet port 217 extends into the typical pilot control nozzle assembly 203 and is connected with the pilot orifice 84, with the pilot port 96 also being in fluid communication with the control piston 40 by way of the bore 36. Similarly, the pilot control nozzle assembly 204 is connected with the pilot orifice 82, with the pilot port 94 also being connected in fluid communication with the control piston 38 by way of the bore 34.

The nozzle inlet port 217 also communicates with an opening 219 that terminates at the nozzle end 221 (nozzle end 222 for nozzle assembly 204). The nozzle ends 221 and 222 are engageable by the respective closure members 213 and 214, which are resiliently biased in opposite directions, away from the armature member 211 and toward the respective nozzle ends 221 and 222.

In operation, the pilot level control apparatus 200 functions in the following manner in order to provide infinitely variable pilot control pressures, with infinitely variable and proportional load pressure levels, while still providing the capability of substantially zero pilot flow at zero input signal when the control valve assembly 110 is in its center-off or neutral condition. When neither torque motor coil 207 nor torque motor coil 208 is energized (or if both are energized with equal currents), the armature member 211 is spring-centered between the pole pieces 205 and 206 by virtue of the center-biased spring support member 212. In this condition, the nozzle closure members 213 and 214 are substantially equally biased away from the armature member 211 toward equal-force sealing engagement with their respective nozzle ends 221 and 222 to prevent venting of either of the pilot ports 94 or 96. Thus the pilot control pressures in pilot ports 94 and 96 are substantially balanced, and are generally equal to the pilot inlet pressure at the pilot inlet 80. Consequently, the spool 42 in the output portion 14 is balanced at its center-off position, with substantially no pilot control fluid flow or electrical input signal and consequently with no flow from the load ports 62 or 64.

When operation of the cylinder 16 is desired, signal current is applied to one or the other (or both) of the electrical coils 207 or 208, thus causing the armature 211 to move closer to the pole piece (205 or 206) surrounded by its respective energized coil. Such armature movement increases the sealing force exerted by the closure member (213 or 214) against its respective nozzle end (221 or 222) at the energized (or greater energized) side of the torque motor 201. At the same time, the armature member 211 pulls the other closure member (213 or 214) at the non-energized or lesser energized side of the torque motor 201, in a direction away from its respective pilot control nozzle end (221 or 222), thus allowing at least partial venting at the non-energized (or lesser energized) side. As a result, the pilot pressure in the pilot port (94 or 96) on the energized (or greater energized) side of the system increases or remains at pilot inlet level with increasing input signal current, while the pilot pressure in the opposite pilot port (94 or 96) at the non-energized (or lesser energized) side of the system decreases with increasing movement of its associated closure member (213 or 214) in a direction away from its respective pilot control nozzle end (221 or 222). The resultant pressure imbalance between the pilot ports 94 and 96 causes corresponding movement of the control pistons 38 and 40 and thus the spool 42, with internal self-regulating feedback as described above in connection with FIG. 1, holding the output load pressure to a level that is twice the differential pilot pressure level (in the above example).

Since the torque motor 201 is capable of infinitely variable bi-directional movement of the armature 211 between the pilot control nozzle ends 221 and 222 in response to infinitely variable differential input signal currents to respective electric coils 207 and 208, the pilot level control apparatus 200 is capable of infinitely variable bi-directional movement of the spool 42 and corresponding self-regulated, infinitely variable load pressures in order to cause reciprocating operation of the cylinder 16, with resulting control of the output force levels therein.

The pilot level control apparatus 200 is thus capable of extremely fine and close control of force levels at the cylinder 16 due to the fact that very small differences in the input signal currents to the coils 207 and 208 result in very small movements of the armature 211 and thus very small differences in pilot pressures at the respective nozzle ends 221 and 222. Furthermore, since the armature movement and pilot pressures are directly proportional to input signal current, and the load pressures are directly proportional to the pilot pressures, the load pressures are directly proportional to input signal current and are correspondingly infinitely and finely controllable.

Figure 3:
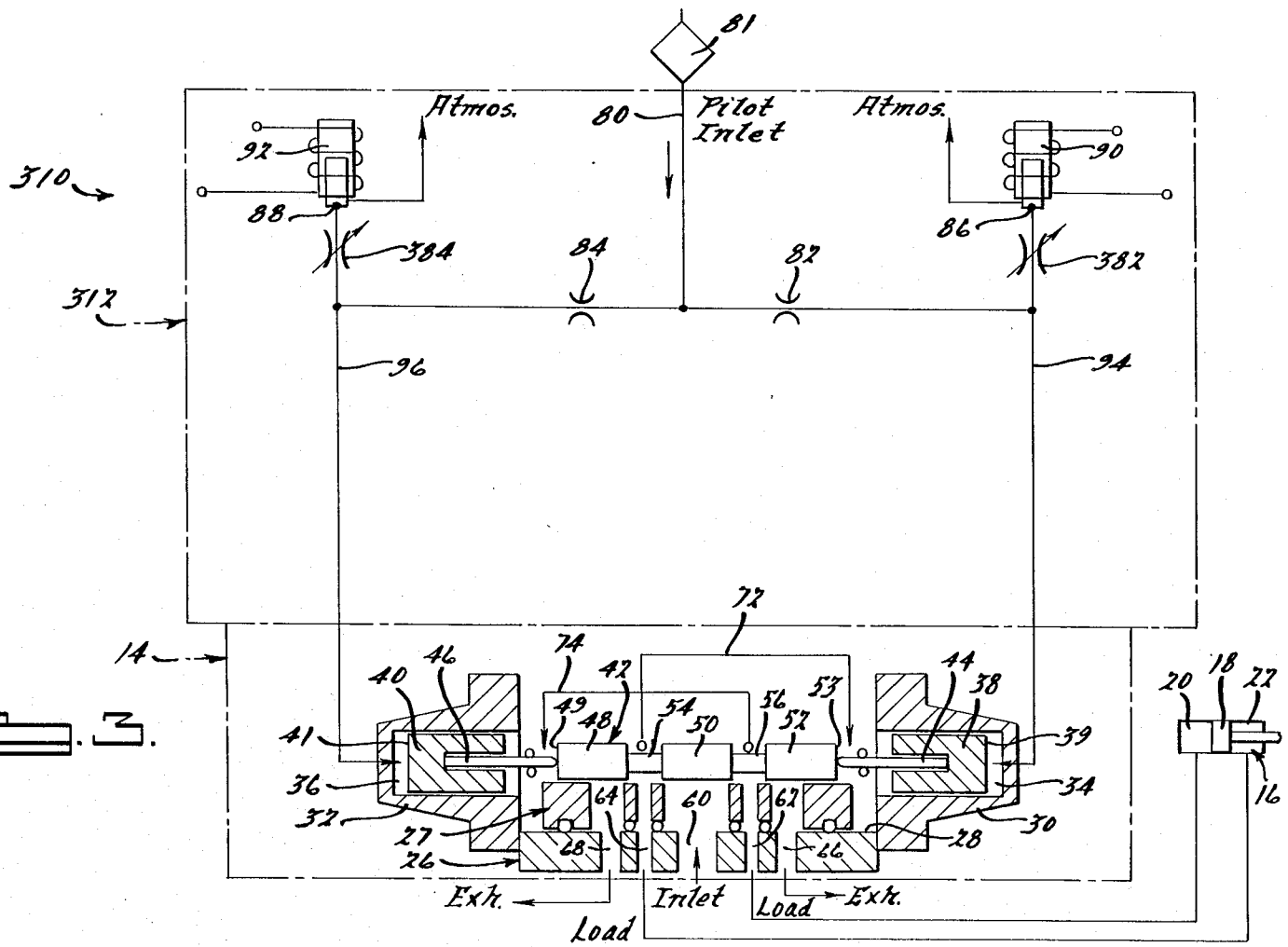
FIG. 3 is a schematic representation similar to that of FIG. 1, but illustrating a simplified alternate embodiment of the present invention.
Figure 1:
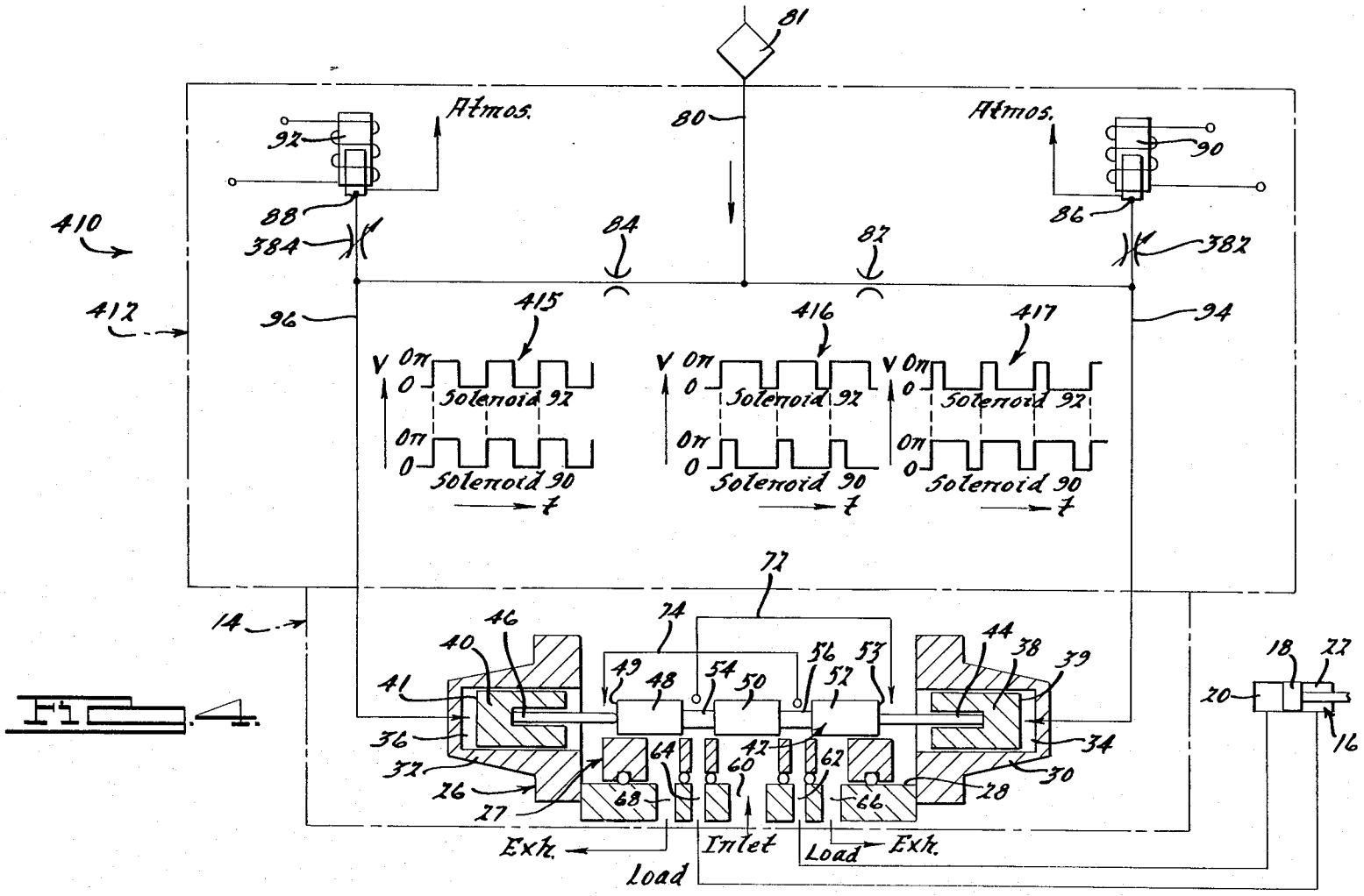

Although the control valve assemblies 10 and 110 in FIGS. 1 and 2 offer several distinct advantages that are very desirable or even necessary in certain applications, not all fluid power systems require such fine or varied control. FIG. 3 schematically illustrates a simplified version of the present invention wherein such selective variations in load pressures are not needed, but in which self-regulating proportional control of one pressure level is available.

In FIG. 3, the pilot level control apparatuses 100 and 200 of FIGS. 1 and 2 are omitted, and adjustable orifices 382 and 384 are added to the system. The adjustable orifices 382 and 384 are in fluid communication with the respective orifices 82 and 84 and their respective normally-closed exhaust orifices 86 and 88. The exhaust orifices 86 and 88 are controlled by the solenoids 90 and 92, respectively. The orifices 382 and 384 can be adjustably preset and locked to orifice sizes that result in a preselected differential pilot pressure drop resulting in a desired, preselected load pressure level at load port 62 or at load port 64. Thus, when the solenoids 90 and 92 are energized together, the spool 42 moves to a position resulting in the preselected load pressure level. If a different load pressure level or output direction is desired, the respective orifices 382 and 384 must be unlocked, set for the new desired load pressure, and again locked at their new settings.

In this operating mode, the pilot pressures in pilot ports 94 and 96 are each set, by way of adjustment of orifices 382 and 384, respectively, to generate a differential control pressure across the control pistons 38 and 40, respectively. The magnitude of each adjusted pilot pressure is limited, by design requirements, to a maximum of 50 percent of the valve inlet supply pressure. The reason for this limitation is to allow the spool 42 to remain at its travel stop with a minimum differential pilot signal across the control pistons equal to 50 percent of the valve inlet supply pressure when operating in the single solenoid control mode. Thus, a feedback pressure at the feedback passageways 72 or 74 as high as 100 percent of the valve inlet supply pressure level still will not overcome the pilot control pressure differential, which is at a minimum of 50 percent of valve inlet supply pressure, thus holding the spool 42 at its respective travel stop. This is due to the preferred two-to-one end area ratio of the pilot circuit/feedback circuit geometry.

Energizing one of either solenoid 90 or solenoid 92 causes the pilot pressure at the pilot ports 94 or 96, respectively, to drop to a maximum level of 50 percent of valve inlet supply pressure (by way of prior adjustment). The pilot pressure at the opposite pilot port is, of course, at 100 percent of the valve inlet supply level since its exhaust orifice is blocked (due to de-energized solenoid). The spool 42 is thus displaced to its travel stop, at which time air from the inlet port 60 to one of the load ports 62 or 64 (depending upon pilot direction) will begin to flow. The maximum level that this load pressure can attain, which is the same as the feedback signal pressure, is not sufficient to move the spool 42 off its stop and back toward center. The spool 42 thus remains at its travel stop, and the valve output load pressure is essentially unregulated and is at or near valve inlet supply level.

With both solenoids 90 and 92 de-energized, however, the spool 42 returns to its center-off or neutral position, in which the load port pressures at 62 and 64 each return to zero level. Under these conditions, with no input signal, there is no pilot flow nor output flow and at most very minor and negligible internal leakage losses. In addition, if the spool 42 should drift from the above-described center-off or neutral position, a resulting pressure rise in one of the load ports will be communicated (due to the above-described feedback passageways) from the affected load port to the opposite spool end, thus causing the spool to return to the center-off or neutral position.

FIG. 4 schematically illustrates still another variation on the present invention that is similar to that of FIG. 3, but which incorporates the capability of input signal pulse width modulation in order to variably control load output. In FIG. 4, a control valve assembly 410 is substantially identical in terms of its configuration or hardware to the control valve assembly 310, but can be operated somewhat differently.

The pre-adjustable orifices 382 and 384 are generally not needed for this type of pilot control and would be retracted to reduce the restriction in pilot flow to exhaust. However, unlike the operation described above for FIG. 3, wherein the solenoids 90 and 92 are simply energized or de-energized to open or close the corresponding orifices 86 and 88, the current input signals to each of the solenoids 90 and 92 can be modulated, either singly or simultaneously, by modulating their on-off pulse widths to correspondingly modulate pilot pressure levels. The pressure pulses produced by the rapid opening and closing of the exhaust orifices 86 and 88 in pilot circuits 94 and 96, respectively, result in a pressure level averaging over a period of time. The difference between the two average pilot pressures is the control piston differential pressure signal, which displaces the spool 42 in the same manner as described above in connection with other exemplary embodiments.

In the graphic representations of electrical solenoid signal inputs illustrated in FIG. 4, the reference numeral 415 indicates a plot of input signal versus time for solenoids 90 and 92, wherein the input signal pulse width is modulated the same for both solenoids 90 and 92. This operational mode results in equal pilot pressure averaging acting in opposite directions on both control pistons 38 and 40 of the output portion 14, for equal coincident time periods. Thus, the spool 42 will remain at its center-off position.

If, however, the respective electrical input signals are pulse-width modulated in a manner such that the solenoids 90 and 92 are energized for different durations, an unbalanced signal differential results, such as that illustrated by reference numerals 416 and 417. In such an operating mode, the spool 42 will be caused to drift toward one side or the other, as a result of the correspondingly unbalanced pilot pressures exerted on the control pistons 38 and 40. Therefore, by selectively modulating the pulse widths of the electric input signals to solenoids 90 and 92, and consequently modulating the respective pilot pressures exerted on the respective control pistons 38 and 40, the load outputs at the respective load ports 62 and 64 can be closely controlled. In fact, such electrical input signals can be programmed, using microprocessors or other known electrical or electronic signal processing devices, to cause a programmed, desired load output sequence in order to attain a desired operational force control sequence of the cylinder 16. In such an arrangement, the operation of the cylinder 16 can be programmed in the sense that operational external feedback signals from the system in which the cylinder 16 is used can be used by appropriate electrical signal processors to adjust the electrical signal input sequences for the solenoids 90 and 92 in response to changing system conditions. Such electrical signal processing devices or apparatuses are well-known to those skilled in the art and thus are not described in detail herein.

The various illustrative and exemplary alternate embodiments of the present invention offer a wide variety of capabilities for controlling control valves by way of external signal conditioning for a wide variety of applications. Such capabilities include simplified control where maximum load output variations or adjustability is neither desired nor required, as well as providing for applications where infinite variations or adjustability of the load output is needed. Such capabilities are provided in a control valve apparatus that is relatively simple to operate and relatively inexpensive while still offering the high degree of control precision required in many modern applications.

The foregoing discussion discloses and describes merely illustrative or exemplary embodiments of the present invention. One skilled in the art will readily recognize from such discussion, and from the accompanying drawings and claims, that various changes, modifications, and variations can be made therein without departing from the spirit and scope of the invention as defined in the following claims.

What is claimed is:

1. In a pneumatic fluid control valve apparatus having a working fluid inlet connectable to a source of pressurized pneumatic working fluid, a pair of working fluid load outlets, a movable valve member, and a pilot operator for selectively applying a pneumatic control fluid pressure to the movable valve member in order to communicate a selected one of the load outlets with the working fluid inlet to produce load outlet pressures dependent upon the position of the movable valve member, the improvement wherein the pilot operator includes a pair of control pistons interconnected with opposite sides of the movable valve member, the pilot operator being selectively operable to apply control fluid pressure to a selected one of said control pistons and to exhaust control fluid pressure from the other of said control pistons in order to cause selective movement of the movable valve member in either of opposite directions, said control valve apparatus including self-regulation means for maintaining the load outlet pressure proportional to the control fluid pressure, said self-regulation means including portions on opposite sides of the movable valve member and feedback means in fluid communication with said valve member portions for applying load outlet pressure from said selected load outlet to one of said valve member portions in order to tend to urge said movable valve member in a direction opposing movement of the movable valve member in a direction that communicates the working fluid inlet with said selected load outlet, the area of each of said control pistons being greater than the area of each of said valve member portions, the load outlet pressure at said selected load outlet being proportional to the control fluid pressure applied to said one of said control pistons in the same ratio as the ratio of the area of said one of said control pistons to the area of said one of said valve member portions, the pilot operator further including means for selectively applying equal control fluid pressures to both of said control pistons simultaneously in order to maintain the movable valve member in a center-off position with substantially no working fluid flow and substantially no control fluid flow, said self-regulation means also tending to maintain the movable valve member in said center-off position in the event of undesired movement from said center-off position.

2. The improvement according to claim 1, wherein the area of each of said control pistons is approximately twice the area of each of said valve member portions.

3. The improvement according to claim 1, wherein said improvement further includes adjustment means for selectively adjusting the pressure of the control fluid applied to each of said control pistons to a predetermined pressure level.

4. The improvement according to claim 1, wherein said improvement further includes adjustment means for selectively adjusting the pressure of the control fluid applied to each of said control pistons to any of a number of predetermined pressure levels.

5. The improvement according to claim 1, wherein said improvement further includes adjustment means for selectively infinitely adjusting the pressure of the control fluid applied to each of said control pistons to any of an infinite number of pressure levels.

6. The improvement according to claim 1, wherein the pilot operator includes modulation means for selectively and separately modulating the application of control fluid pressure to, and for exhausting control fluid pressure from, each of said control pistons in order to selectively move the movable valve member to any of a number of positions in order to selectively control the pressure level of the working fluid communicated to said selected load outlet.

7. The improvement according to claim 6, wherein said modulation means includes an orifice in fluid communication with each of said control pistons, and electrical solenoid means selectively energizable for communicating each of said control pistons with the atmosphere through said orifice in order to selectively exhaust control fluid pressure therefrom, and means for separately and independently selectively modulating the time duration of energization and de-energization of each of said electrical solenoid means.

8. The improvement according to claim 1, wherein said pilot operator further includes electric solenoid means associated with each of said control pistons selectively energizable for exhausting control fluid pressure from each of said control pistons and selectively de-energizable for applying control fluid pressure to each of said control pistons, said electric solenoid means also being de-energizable for applying control fluid pressure to both of said control pistons simultaneously in order to maintain the movable valve member in said center-off position with substantially no electrical input to said electrical solenoid means.

9. The improvement according to claim 8, wherein the pilot operator further includes modulation means for selectively and separately modulating the time duration of energization and de-energization of each of said electrical solenoid means in order to selectively and separately modulate the application of control fluid pressure to, and exhausting control fluid pressure from, each of said control pistons in order to selectively move the movable valve member to any of a number of positions and thereby selectively control the load outlet pressure at said selected load outlet.

10. The improvement according to claim 1, wherein the pilot operator includes pilot control means in the pilot operator for selectively and infinitely varying the load output pressure at each of the load outlets, said pilot control means including an electric torque motor having a bi-directional movable armature, a pair of selectively energizable electric coils for moving said armature in selected opposite directions, said pilot control means further including a pair of opposed open pilot control nozzles on opposite sides of said armature, each of said control nozzles being in fluid communication with one of said control pistons and with the atmosphere, and nozzle closure members carried by said movable armature for engaging said pilot control nozzles with infinitely variable engaging force in response to movement of said movable armature in order to infinitely vary the size of the nozzle opening and pressure drop between said control pistons and the atmosphere in order to correspondingly infinitely vary the control fluid pressure applied to said control pistons and correspondingly vary the proportional load output pressure at said selected load outlet, said closure members being resiliently biased away from said armature in opposite directions in order to engage said pilot control nozzles with equal engaging force when both of said electric coils are de-energized in order to balance the control fluid pressure applied to the control pistons and maintain the movable valve member in a center-off position with substantially no load outlet flow, substantially no control fluid flow, and substantially no electrical input signal to said electrical coils.

11. The improvement according to claim 1, wherein the pilot operator includes electric solenoid means associated with each of said control pistons selectively energizable for exhausting control fluid pressure from each of said control pistons and selectively de-energizable for applying control fluid pressure to each of said control pistons, said electric solenoid means also being de-energizable for applying control fluid pressure to both of said control pistons simultaneously in order to maintain the movable valve member in said center-off position with substantially no electrical input signal to said electrical solenoid means, said pilot operator further including a pre-adjustable orifice in fluid communication with each of said control pistons, one of said electric solenoid means being energizable for communicating each of said control pistons with the atmosphere through one of said pre-adjustable orifices, said pre-adjustment of said orifices causing a pre-adjustable pressure drop therethrough in order to pre-adjust the control fluid pressure and the corresponding proportional load outlet pressure at said selected load outlet.

12. The improvement according to claim 1, wherein the pilot operator includes electric solenoid means associated with each of said control pistons selectively energizable for exhausting control fluid pressure from each of said control pistons and selectively de-energizable for applying control fluid pressure to each of said control pistons, said electric solenoid means also being de-energizable for applying control fluid pressure to both of said control pistons simultaneously in order to maintain the movable valve member in said center-off position with substantially no electrical input signal to said electrical solenoid means, said pilot operator further including a pre-adjustable orifice in fluid communication with each of said control pistons, one of said electric solenoid means being energizable for communicating each of said control pistons with the atmosphere through one of said pre-adjustable orifices; and electrical modulation means associated with said electric solenoid means for selectively and separately modulating the time duration of energization and de-energization of each of said electrical solenoid means in order to selectively and separately modulate the application of control fluid pressure to, and exhausting control fluid pressure from, each of said control pistons in order to selectively move the movable valve member to any of a number of positions and thereby selectively control the load outlet pressure at said selected load outlet.

13. The improvement according to claim 1, wherein said area of each of said valve member portions is substantially equal to the lateral cross-sectional area of said movable valve member.

14. In a pneumatic fluid control valve apparatus having a working fluid inlet connectable to a source of pressurized pneumatic working fluid, a pair of working fluid load outlets, a movable valve member, and a pilot operator for selectively applying a pneumatic control fluid pressure to the movable valve member in order to communicate a selected one of the load outlets with the working fluid inlet to produce load outlet pressures dependent upon the position of the movable valve member, the improvement comprising:

self-regulation means including feedback means for applying load outlet pressure from said selected load outlet to the movable valve member in a first direction tending to oppose movement of the movable valve member in a direction that communicates the working fluid inlet with said selected load outlet, the pilot operator including a pair of opposed control pistons interconnected with opposite sides of the movable valve member, the pilot operator being selectively operable for applying control fluid pressure to, and for exhausting control fluid pressure from, each of said control pistons in order to cause selective movement of the movable valve operator in either of opposite directions, said self-regulation means including portions on opposite sides of the movable valve member in fluid communication with said feedback means, said feedback means including means for applying load outlet pressure from said selected load outlet to a selected one of said valve member portions in a second direction tending to oppose movement of the movable valve member in said first direction that communicates the working fluid inlet with said selected load outlet, the area of each of said control pistons being greater than the area of each of said valve member portions, the load outlet pressure at said selected load outlet being proportional to the control fluid pressure applied to said one of said control pistons in the same ratio as the ratio of the area of said one of said control pistons to the area of said one of said valve member portions;

center-off means in the pilot operator for selectively applying equal control fluid pressures to both of said control pistons simultaneously in order to maintain the movable valve member in a center-off position with substantially no load outlet flow and substantially no control fluid flow, said self-regulation means also tending to maintain the movable valve member in said center-off position in the event of undesired movement from said center-off position, said center-off means including electric solenoid means associated with each of said control pistons and being selectively energizable for exhausting control fluid pressure from each of said control pistons and selectively de-energizable for applying control fluid pressure to each of said control pistons, said electric solenoid means also being de-energizable for applying control fluid pressure to both of said control pistons simultaneously in order to maintain the movable valve member in said center-off position with substantially no electrical input signal to said electrical solenoid means, said pilot operator further including a pilot orifice in fluid communication with each of said control pistons, one of said electric solenoid means being energizable for communicating each of said control pistons with the atmosphere through one of said pilot orifices; and pilot control means in the pilot operator for selectively changing the load outlet pressure at each of the load outlets, said pilot control means including at least one pilot control orifice in fluid communication with said control pistons and control means for selectively communicating each of said control pistons with the atmosphere separately and independently, said pilot control orifice being adjustable to cause a predetermined control fluid pressure drop therethrough in order to cause a corresponding predetermined control fluid pressure and a corresponding proportional load outlet pressure at said selected load outlet.

15. The improvement according to claim 14, wherein said control means includes pilot control electric solenoid means selectively and remotely energizable to cause said communication between each of said control pistons and the atmosphere through said adjustable pilot control orifice.

16. The improvement according to claim 14, wherein said pilot control orifices are pre-adjustable to a preselected orifice size corresponding to a preselected load outlet pressure.

17. The improvement according to claim 14, wherein said pilot control orifices are each infinitely adjustable to an infinite number of orifice sizes corresponding to an infinite number of load outlet pressures.

18. The improvement according to claim 14, wherein said area of said valve member portions is substantially equal to the lateral cross-sectional area of said movable valve member.

19. In a pneumatic fluid control valve apparatus having a working fluid inlet connectable to a source of pressurized pneumatic working fluid, a pair of working fluid load outlets, a movable valve member, and a pilot operator for selectively applying a pneumatic control fluid pressure to the movable valve member in order to communicate a selected one of the load outlets with the working fluid inlet to produce load outlet pressures dependent upon the position of the movable valve member, the improvement comprising:

self-regulation means including feedback means for applying load outlet pressure from said selected load outlet to the movable valve member in a direction tending to oppose movement of the movable valve member in a direction that communicates the working fluid inlet with said selected load outlet, the pilot operator including a pair of opposed control pistons interconnected with opposite sides of the movable valve member, the pilot operator being selectively operable for applying control fluid pressure to, and for exhausting control fluid pressure from, each of said control pistons in order to cause selective movement of the movable valve operator in opposite directions, said self-regulation means including portions on opposite sides of the movable valve member in fluid communication with said feedback means, said feedback means including means for applying load outlet pressure from said selected load outlet to a selected one of said portions of the movable valve member in a direction tending to oppose movement of the movable valve member in a direction that communicates the working fluid inlet with said selected load outlet;

center-off means in the pilot operator for applying equal control fluid pressures to both of said control pistons simultaneously in order to maintain the movable valve member in a center-off position with substantially no load outlet flow and substantially no control fluid flow, said center-off means including electric solenoid means associated with each of said control pistons and being selectively energizable for exhausting control fluid pressure from each of said control pistons and selectively de-energizable for applying control fluid pressure to each of said control pistons, said electric solenoid means also being de-energizable for applying control fluid pressure to both of said control pistons simultaneously in order to maintain the movable valve member in said center-off position with substantially no electrical input signal to said electrical solenoid means, said pilot operator further including a pilot orifice in fluid communication with each of said control pistons, one of said electric solenoid means being energizable for communicating each of said control pistons with the atmosphere through one of said pilot orifices; and pilot control means in the pilot operator for selectively changing the load outlet pressure at each of the load outlets, said pilot control means including a number of pilot control orifices in fluid communication with said control pistons and control means for selectively communicating each of said control pistons with the atmosphere separately and independently, said pilot control orifices being adjustable to cause a predetermined control fluid pressure drop therethrough in order to cause a corresponding predetermined control fluid pressure and a corresponding proportional load outlet pressure at said selected load outlet, each of said pilot control orifices being pre-adjustable to a preselected orifice size corresponding to a preselected load outlet pressure, said pilot control means being adapted for selectively communicating each of said control pistons with the atmosphere through said pilot control orifices, both individually and in conjunction with other of said pilot control orifices.

20. The improvement according to claim 19, wherein said control means includes pilot control electric solenoid means associated with each of said pilot control orifices, said pilot control electric solenoid means each being selectively and remotely energizable to cause said communication between each of said control pistons and the atmosphere through each of said pilot control orifices, both individually and in conjunction with other of said pilot control orifices.

* * * * *

UNITED STATES PATENT AND TRADEMARK OFFICE

CERTIFICATE OF CORRECTION

PATENT NO. : 4,883,091

DATED : November 28, 1989

INVENTOR(S) : Weiler, et al

It is certified that error appears in the above-identified patent and that said Letters Patent is hereby corrected as shown below:

Column 1, line 52, "selectablility" should be —selectability—.

Column 16, line 58, Claim 14, new paragraph beginning "pilot control means..."

Column 17, line 20, Claim 18, after "of" insert —each of—.

Signed and Sealed this

Sixteenth Day of October, 1990

*Attest:*

HARRY F. MANBECK, JR.

*Attesting Officer*

*Commissioner of Patents and Trademarks*